US008899932B2

(12) United States Patent
Tetkoskie et al.

(10) Patent No.: US 8,899,932 B2
(45) Date of Patent: Dec. 2, 2014

(54) MOLTEN METAL IMPELLER

(75) Inventors: Jason Tetkoskie, Cleveland Heights, OH (US); Mark A. Bright, Sewickley, PA (US); Richard S. Henderson, Solon, OH (US)

(73) Assignee: Pyrotek, Inc., Solon, OH (US)

( * ) Notice: Subject to any disclaimer, the term of this patent is extended or adjusted under 35 U.S.C. 154(b) by 733 days.

(21) Appl. No.: 13/176,254

(22) Filed: Jul. 5, 2011

(65) Prior Publication Data

US 2012/0003099 A1 Jan. 5, 2012

Related U.S. Application Data

(60) Provisional application No. 61/361,075, filed on Jul. 2, 2010.

(51) Int. Cl.
*F04D 7/06* (2006.01)
*F04D 29/22* (2006.01)

(52) U.S. Cl.
CPC ..... *F04D 7/065* (2013.01); *F04D 29/22* (2013.01)
USPC ..... 416/185; 416/224

(58) Field of Classification Search
USPC ..... 416/224, 223 B, 183, 185; 415/121.1
See application file for complete search history.

(56) References Cited

U.S. PATENT DOCUMENTS

| | | | | |
|---|---|---|---|---|
| 5,470,201 | A | 11/1995 | Gilbert et al. | |
| 5,685,701 | A | 11/1997 | Chandler et al. | |
| 5,785,494 | A | 7/1998 | Vild et al. | |
| 6,019,576 | A * | 2/2000 | Thut | 415/200 |
| 6,074,455 | A | 6/2000 | van Linden et al. | |
| 6,250,881 | B1 | 6/2001 | Mordue et al. | |
| 6,451,247 | B1 | 9/2002 | Mordue et al. | |
| 6,869,564 | B2 | 3/2005 | Gilbert et al. | |
| 6,918,741 | B2 | 7/2005 | Gilbert et al. | |
| 7,144,217 | B2 | 12/2006 | Gilbert et al. | |
| 2004/0262825 | A1 | 12/2004 | Cooper | |
| 2005/0013713 | A1 * | 1/2005 | Cooper | 417/423.14 |
| 2006/0245921 | A1 * | 11/2006 | Morando | 415/206 |

FOREIGN PATENT DOCUMENTS

| | | |
|---|---|---|
| EP | 0 586 800 | 9/1997 |
| JP | 06-050281 | 2/1994 |
| WO | WO 98/15736 | 4/1998 |
| WO | WO 03/019012 | 3/2003 |
| WO | WO 2009-143569 | 12/2009 |

OTHER PUBLICATIONS

International Search Report from PCT/US2011/042944.

* cited by examiner

*Primary Examiner* — Richard Edgar
(74) *Attorney, Agent, or Firm* — Fay Sharpe LLP

(57) ABSTRACT

According to one embodiment, a molten metal impeller is provided. It includes a generally cylindrical graphite body having a plurality of passages extending from a top surface to a side wall. A hub is formed in the center of the graphite body. A ceramic cap member is secured to the top surface of the graphite body. The cap member is comprised of a ring forming a central passage shaped cooperatively to overlap the hub and a plurality of vanes extending radially from the ring to an outer rim. The rim has a height between adjacent vanes which increases in the direction of intended impeller rotation. The rim further has a height which decreases from its radially outer most edge to an inner most edge.

22 Claims, 6 Drawing Sheets

MOLTEN METAL IMPELLER

The present application claims priority to U.S. Provisional Patent Application No. 61/361,075 filed on Jul. 2, 2010, which is incorporated herein by reference.

BACKGROUND

The present disclosure is directed to a molten metal impeller having improved metal flow properties. According to one embodiment, a protective flow inducing cap member for a molten metal pump impeller is provided.

This disclosure generally relates to molten metal pumps. More particularly, this disclosure relates to an impeller suited for use in a molten metal pump. The impeller is particularly well suited to be used in molten aluminum pumps. However, it should be realized that the impeller can be used in any pump employed in refining or casting molten metals.

In the processing of molten metals, it is often necessary to move molten metal from one place to another. When it is desired to remove molten metal from a vessel, a so called transfer pump is used. When it is desired to circulate molten metal within a vessel, a so called circulation pump is used. When it is desired to purify molten metal disposed within a vessel, a so called gas injection pump is used. In each of these types of pumps, a rotatable impeller is disposed within a pumping chamber in a vessel containing the molten metal. Rotation of the impeller within the pumping chamber draws in molten metal and expels it in a direction governed by the design of the pumping chamber.

In each of the above referenced pumps, the pumping chamber is formed in a base member which is suspended within the molten metal by support posts or other means. The impeller is supported for rotation in the base member by means of a rotatable shaft connected to a drive motor located atop a platform which is also supported by the posts.

An exemplary pump in which the impeller of this disclosure can operate is depicted in FIG. 1. FIG. 1 depicts the arrangement of the impeller 14 in a molten metal pump 32. Particularly, a motor 34, is secured to a motor mount 36. A riser 38 (indicating this pump to be a transfer-style) through which molten metal is pumped is provided. The riser 38 is attached to the motor mount 36 via a riser socket 40. A pair of refractory posts 42 are secured by a corresponding pair of post sockets 44, a rear support plate 46 and bolts 48 to the motor mount 36. At a second end, each of the posts 42, and the riser 38, are cemented into a base 50. The base 50 includes a pumping chamber 52, in which the impeller 14 is disposed. The pumping chamber is constructed such that the impeller bearing ring 10 is adjacent the base bearing ring 54. The impeller is rotated within the pumping chamber via a shaft 59 secured to the motor by a threaded connection 60 pinned to a universal joint 62.

Obviously, there is a desire to increase the efficiency of a molten metal impeller. Improving the flow of metal into the impeller is one mechanism by which this is achieved. It is a further desire to limit the degradation of the impeller. Moreover, to operate in a high temperature, reactive molten metal environment, a graphite material is typically used to construct the impeller. Graphite is prone to degradation when exposed to particles entrained in the molten metal. More specifically, the molten metal may include pieces of the refractory lining of the molten metal furnace, undesirables from the metal feed stock and occlusions which develop via chemical reaction, all of which can cause damage to an impeller.

BRIEF DESCRIPTION

According to one embodiment, a molten metal impeller is provided. It includes a generally cylindrical graphite body having a plurality of passages extending from a top surface to a side wall. A hub is formed in the center of the graphite body. A ceramic cap member is secured to the top surface of the graphite body. The cap member is comprised of a ring forming a central passage shaped cooperatively to overlap the hub and a plurality of vanes extending radially from the ring to an outer rim. The rim has a height between adjacent vanes which increases in the direction of intended impeller rotation, The rim also has a height which decreases from its radially outer most edge to an inner most edge.

According to a further embodiment, a molten metal impeller comprised of a graphite body having a central hub disposed upon a generally disk shaped base and at least two vanes extending from the hub is provided. A ceramic cap member engages a top surface of the graphite body. The cap member has a central ring sized to overlay the hub and wings extending therefrom. The wings are shaped to cooperatively overlay the vanes. Each wing includes a terminal end with a vane engaging edge and an opposed chamfered edge.

According to a further embodiment, a molten metal impeller comprised of a generally cylindrical graphite body is provided. The graphite body includes a plurality of vanes defining passages extending from a first surface to a side wall. A ceramic cap member is secured to the first surface. The cap member is comprised of a plurality of vanes corresponding to the plurality of graphite body vanes and a rim. The rim includes a plurality of segments between adjacent vanes wherein the segments have a height profile which increases in the direction of intended impeller rotation.

According to an additional embodiment, a molten metal impeller is provided. The impeller is comprised of a graphite body having an at least substantially cylindrical sidewall and opposed top and bottom end walls. At least one of the end walls forms an inlet comprised of multiple passages extending to the sidewall. The passages are defined by a plurality of radially extending vanes and a peripheral rim. The vanes have a terminal portion intersecting the rim. The terminal portions are canted in the intended direction of impeller rotation. In addition, the sections of rim between the vanes include a surface which slopes downward away from the direction of intended impeller rotation.

BRIEF DESCRIPTION OF THE DRAWINGS

In accordance with one aspect of the present exemplary embodiment.

DETAILED DESCRIPTION

Figure 1:
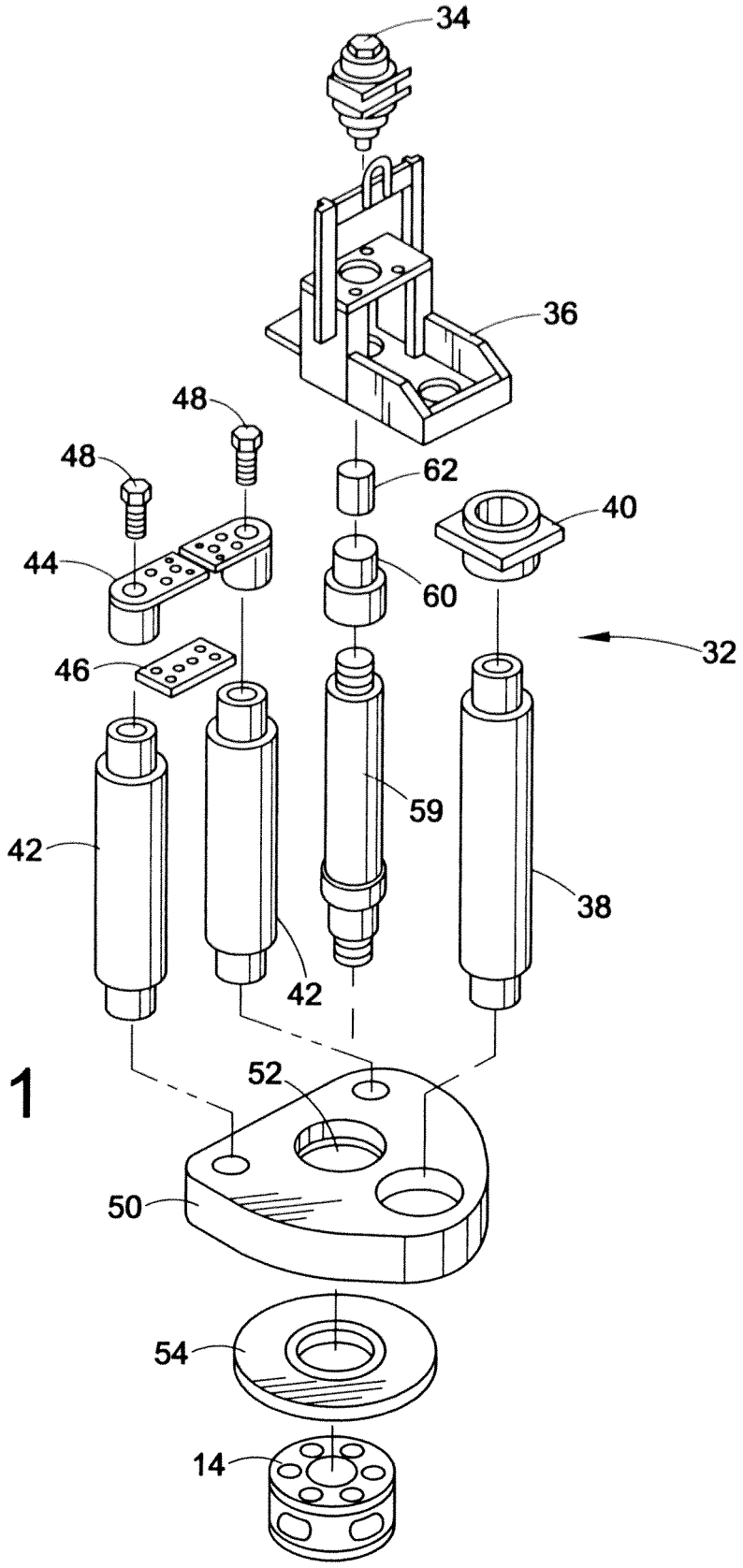
FIG. 1 is a perspective view of a prior art molten metal pump.
Figure 2:
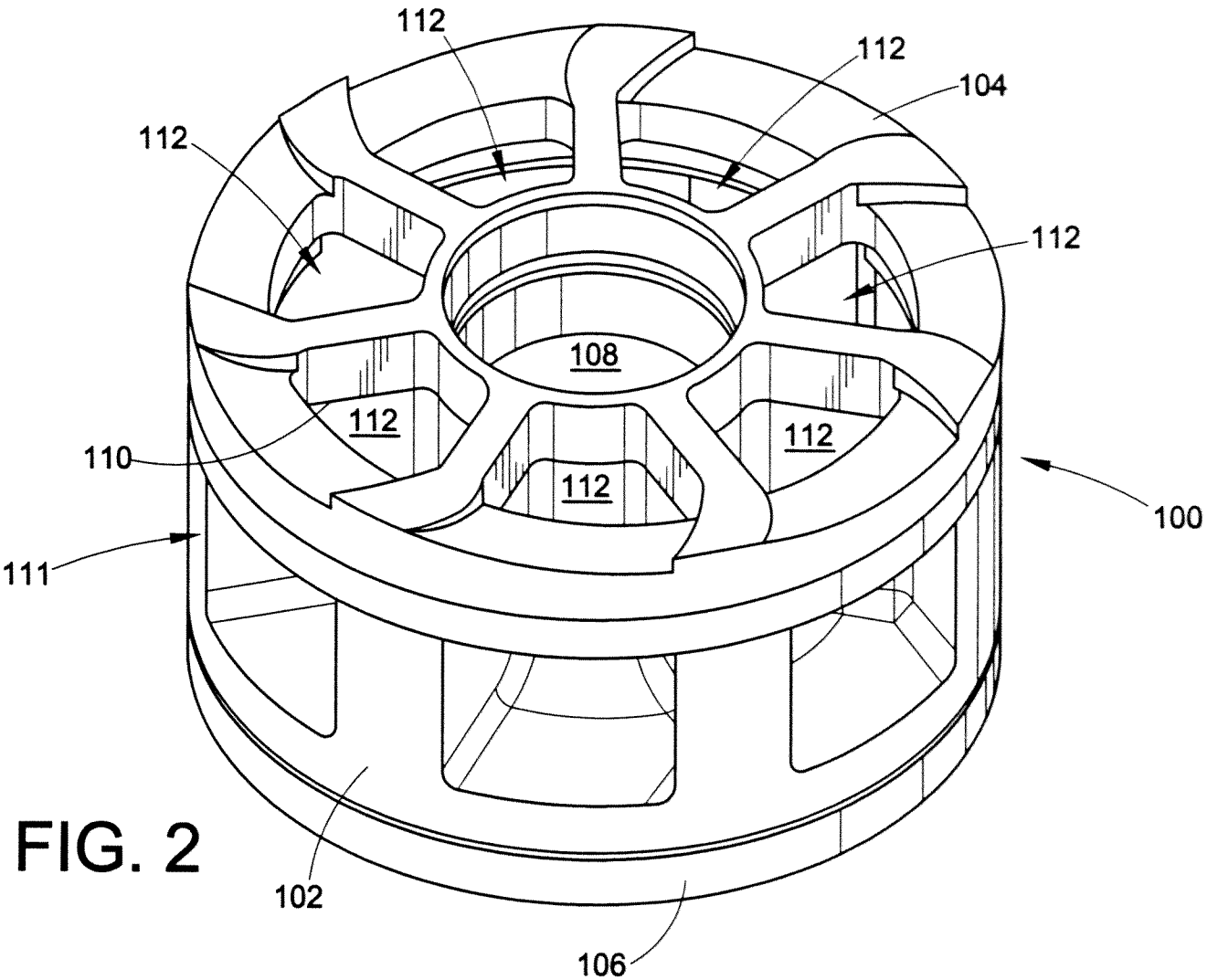
FIG. 2 is an perspective view of the present impeller.

Reference will now be made in detail to the representative embodiments of the invention, examples of which are illustrated in the accompanying drawings. While the invention will be described in connection with the selected embodiments, it will be understood that it is not intended to limit the invention to those embodiment. On the contrary, it is intended to cover all alternatives, modifications and equivalents that may be included within the spirit and scope of the invention defined by the appended claims.

A new and improved impeller for use in molten metal pumps is disclosed. In particular, the impeller is utilized in molten metal pumps to create a forced directional flow of molten zinc or molten aluminum. U.S. Pat. Nos. 2,948,524; 5,078,572, 5,088,893; 5,330,328; 5,308,045, 5,470,201 and 6,464,458 herein incorporated by reference, describe a variety of molten metal pumps and environments in which the present impeller could be used.

Referring now to FIGS. 2-5, impeller 100 is depicted. Impeller 100 includes three main components; a graphite body 102, a top cap 104, and a bearing ring 106. A hub 108 is centrally formed in the graphite body 102 to receive a shaft. Although indicated as cylindrical in shape, the hub and corresponding top cap passage could be formed to have flat surfaces for mating with a cooperatively shaped shaft. It is further envisioned that the present embodiment is functional with an impeller which connects to a shaft via a mechanism other than a hub. For example, a threaded post could extend from the impeller body and be received within a threaded bore of a shaft. The present disclosure contemplates use with the myriad of shaft impeller connections available to the skilled artisan.

Graphite body 102 is generally cylindrically shaped and includes a plurality of passages 112 extending from an upper surface 110 to side wall 111. Four or more passages are typically present. Cap 104 is secured (for example via cement) to upper surface 110. Although reference is made to passages originating in a top surface, it is noted that bottom feed impellers can similarly benefit from the present disclosure. Accordingly, contemplated within this disclosure are impellers having either top or bottom surface passages or both. Similarly, it is envisioned that the cap can be secured to either or both top and bottom surfaces.

Figure 4:
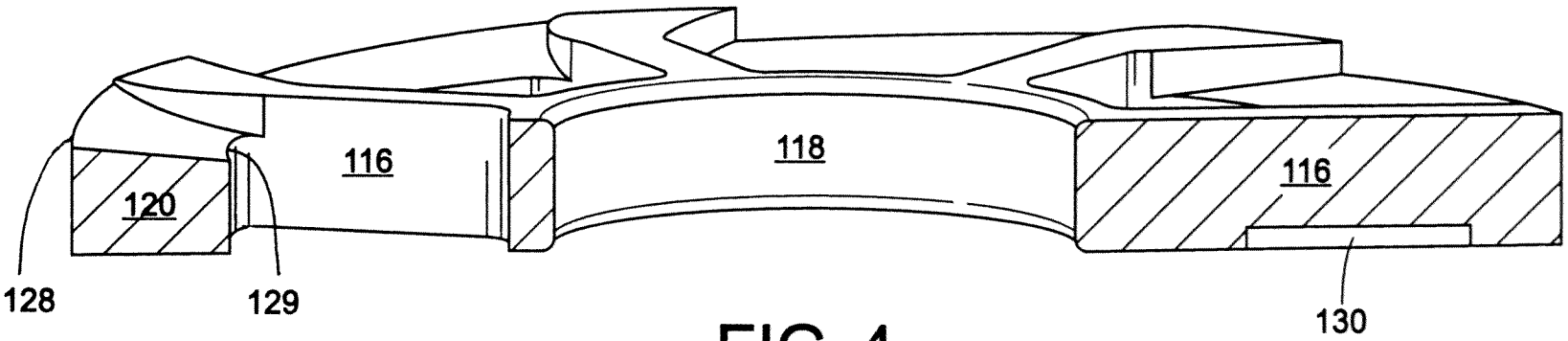
FIG. 4 is a cross-section taken along lines A-A of FIG. 3.

With reference to FIG. 4, the cement joinder of the cap member 104 to the graphite body 102 can be enhanced by including cooperative grooves 130 in the mounting surfaces of each (not shown in the graphite body). Moreover, in this manner a cement channel is formed that extends into the top cap 104 and into the graphite body 102. In addition, in certain environments, it may be desirable to extend a pin between the cap member 104 and the graphite body 102.

Figure 3:
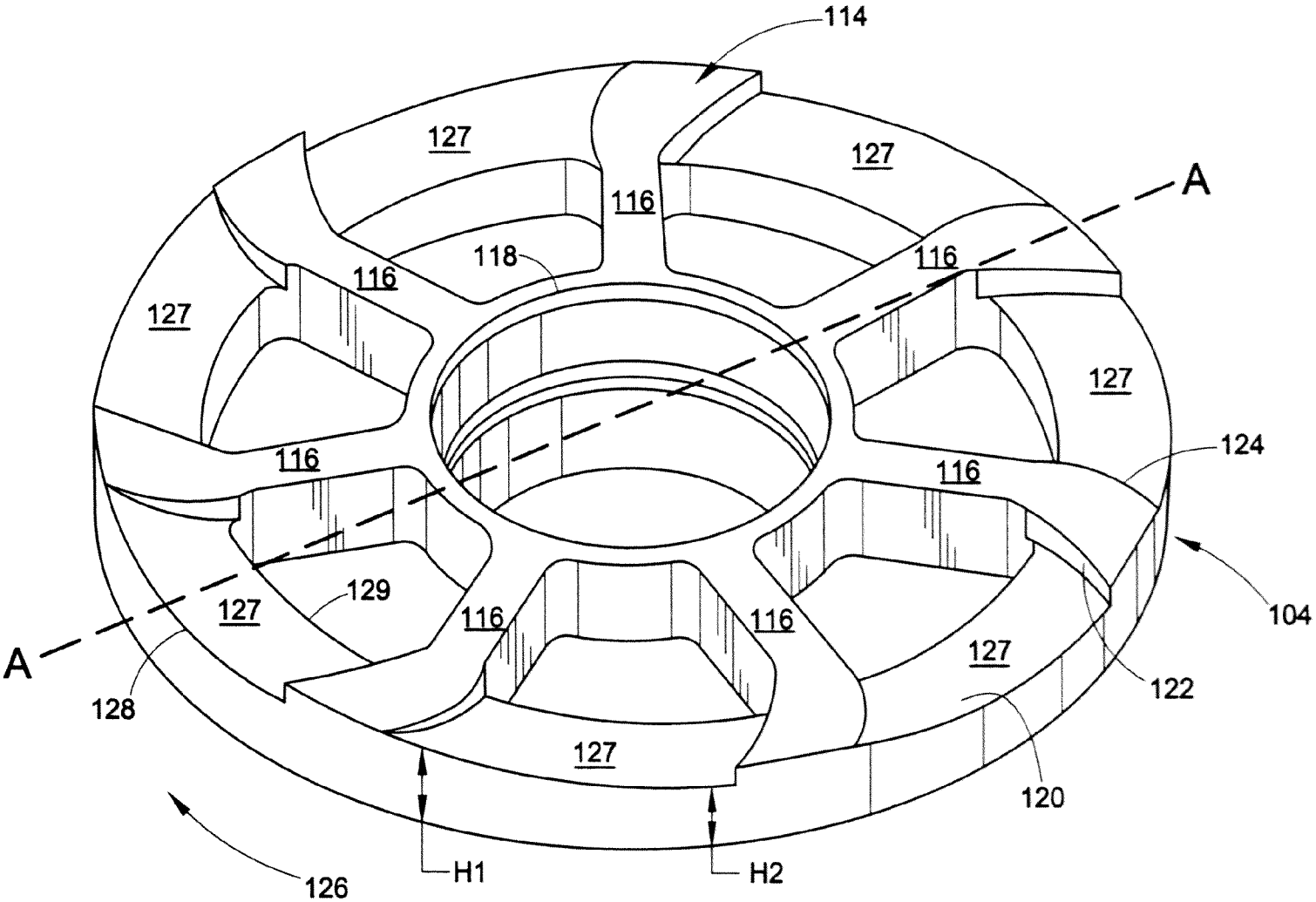
FIG. 3 is a perspective view of the cap member removed from the impeller of FIG. 2.
Figure 5:
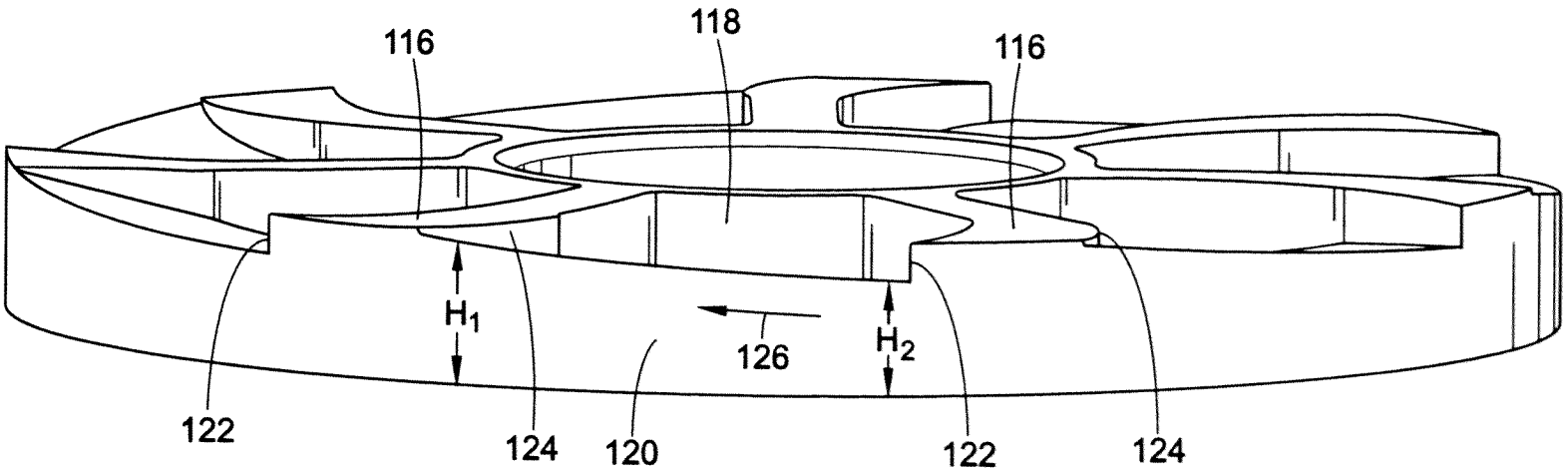
FIG. 5 is a side elevation view of the cap member of FIG. 3.

Cap member 104 can be shaped to generally match the outline shape of graphite body 102. Cap member 104 further has a top surface 114 profile which encourages induction of fluid. Referring now to FIGS. 3 and 5, vanes 116 extend radially from a central ring 118 to an outer rim 120. Rim 120 include segments between adjacent vanes having a height profile which slopes downwardly from H1 to H2 between adjacent vanes 116. H1 is greater than H2 such that the terminal portion of vanes 116 have a higher leading edge 122 than trailing edge 124 to create a scooping action in the direction of intended rotation 126. In certain embodiments, the ratio of H1:H2 is at least 4:3. Furthermore, the leading edge 122 may be forwardly canted (in the direction of intended impeller rotation 126) relative to the portion of vane 116 between central ring 118 and outer rim 120. Trailing edge 124 can also be forwardly canted. In addition, top surface 114 includes a flow inducing surface 127 which slants downwardly from its peripheral edge 128 to its inner edge 129 adjacent passages 112, effectively funneling molten metal therein. Moreover, there is an incline in surface 127 relative to the planar orientation of the cap member 104. In an exemplary embodiment the incline is at least 5 degrees.

Figure 6:
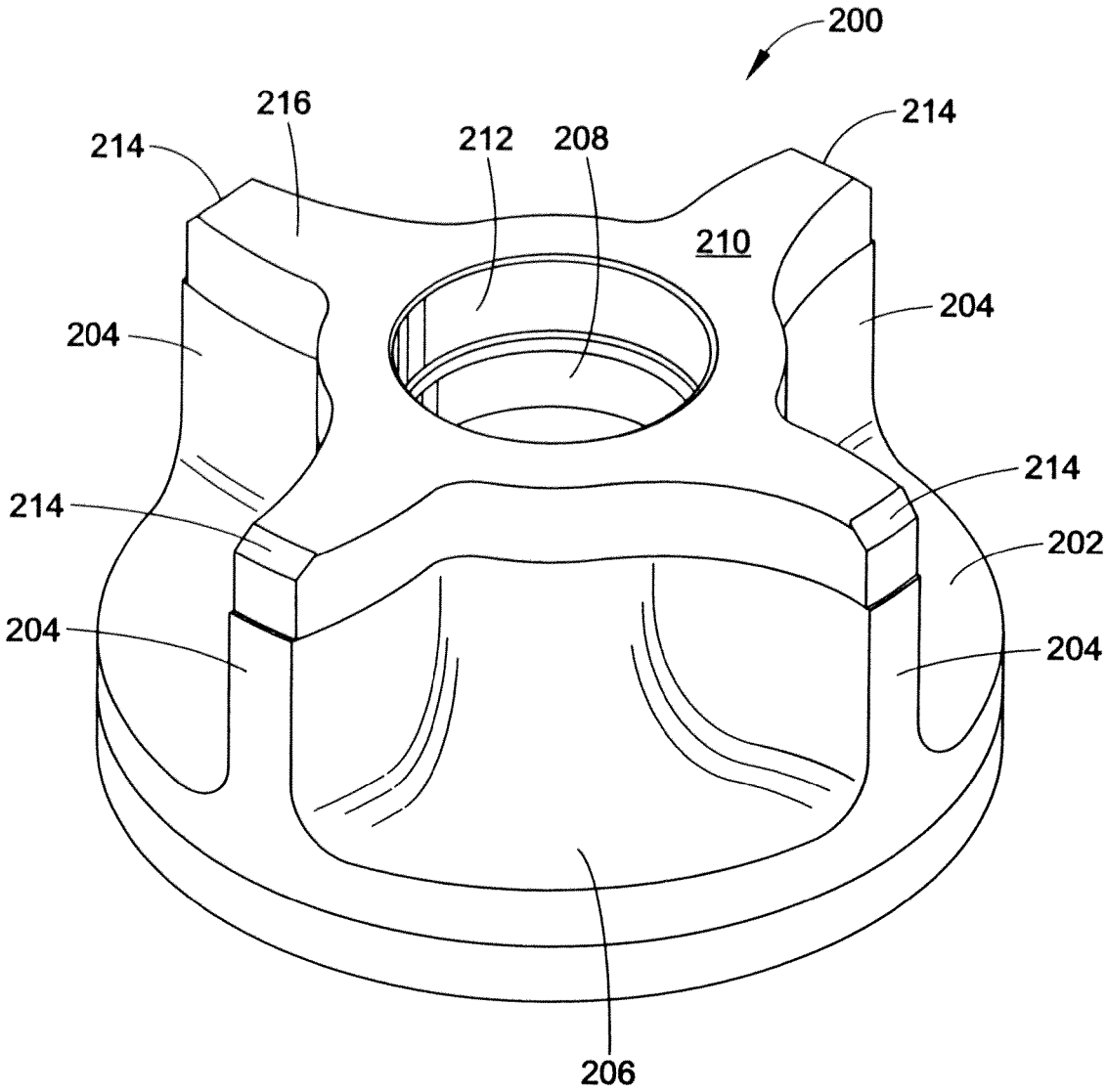
FIG. 6 is a perspective view of an alternative impeller embodiment.

Referring now to FIG. 6, an open top impeller 200 is depicted. In this embodiment, the impeller includes four blades 204 which reside upon a disk shaped base 206 and extend from hub 208. Cap 210 is shaped to mate with and overlay the vanes and includes a passage 212 providing access to hub 208 which accommodates a shaft. The cap member includes chamfered radial edges 214, provided to facilitate the placement of the impeller within the pump housing. Moreover, referring again to FIG. 1, during installation, the impeller is typically installed via insertion through the lower opening of the pump housing. Given the hardness of the material forming the cap member, sharp edges thereon at the radial surface would increase the likelihood of chipping and/or otherwise damaging the pump housing during the installation step. The chamfer allows proper registration of the impeller within the pump housing without causing chipping damage. A preferred chamfer forms an angle relative to the planar surface 216 of the cap member of between about 20 and 60° or about 30 and 50°.

The present design has been found particularly effective in high rock inclusive molten metal environments. Particularly, the high strength cap member has been found to provide increased strength. In general, in each embodiment, the cap member can be comprised of a fine grain refractory material, such as silicon carbide. Preferably, the material has a suitable coefficient of thermal match to graphite, for example, no more than a three to one difference. In this regard, SiC having a $2.2\times10^{-6}$ in/in/° F. and graphite having a $7\times10^{-7}$ in/in/° F. are sufficiently compatible. Furthermore, it is noted that the grain size of the fine grain refractory is preferably not too fine (for example larger than 3 microns may be desirable; although if a mixture of particle sizes is employed it is feasible even smaller sized particles could be present provided larger sized particles are also present such that for example an average particle size layer greater than 3 micros is achieved) to allow cement to suitably grip the material.

In addition, it is noted that although much of the present disclosure has focused on the use of a ceramic cap member to provide the improved flow in combination with protection of the graphite body, the disclosure also contemplates an impeller without the ceramic cap. Moreover, the improved flow design can be machined directly into the surface of the graphite body of the impeller. For environments that have little or no entrained particles, the requirement for a cap is diminished, yet the desire to retain the improved flow of the present inlet shaping remains.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A molten metal impeller comprised of a generally cylindrical graphite body including a plurality of passages extending from a top surface to a side wall, a hub formed in the center of the graphite body, a ceramic cap member secured to the top surface of said graphite body, said cap member being comprised of a ring forming a central passage shaped to cooperatively overlay the hub and a plurality of vanes extending radially from said ring to an outer rim, said rim having a height between adjacent vanes which increases in the direction of intended impeller rotation, said rim further having a height which decreases from its radially outer most edge to an inner most edge creating a incline.

2. The impeller of claim 1 wherein said ceramic cap member is comprised of silicon carbide.

3. The impeller of claim 1 wherein said ceramic comprises a fine grain refractory having a particle size greater than 3 microns.

4. The impeller of claim 1 wherein a ratio of a difference of the height of said rim between adjacent vanes is at least 4:3.

5. The impeller of claim 1 wherein said incline is at an angle of at least 5°.

6. The impeller of claim 1 wherein said graphite body includes a plurality of vanes underlying said ceramic cap member vanes.

7. The impeller of claim 1 comprises at least four passages.

8. The impeller of claim 1 wherein said vanes include a terminal portion forwardly canted in the direction of intended impeller rotation.

9. The impeller of claim 1 further comprising at least one cement filled notch extending cooperatively into both said ceramic cap member and said graphite body.

10. A molten metal pump comprised of a base defining a pumping chamber, at least one post disposed between said base and a motor mount, and a shaft having one end disposed within said pumping chamber, wherein said one end is connected to the impeller of claim 1.

11. A molten metal impeller comprised of a generally cylindrical graphite body including a plurality of vanes defining passages extending from a top or bottom surface to a side wall, a ceramic cap member secured to the surface of said graphite body, said cap member being comprised of a plurality of vanes at least substantially corresponding to said plurality of graphite body vanes and extending to a rim, said rim having segments between adjacent vanes, said segments having a height profile which increases in the direction of intended impeller rotation.

12. The impeller of claim 11 wherein at least a portion of said rim includes a chamfered edge.

13. The impeller of claim 11 wherein said rim, includes a surface distal to said graphite body, said surface being inwardly inclined.

14. The impeller of claim 11 wherein said vanes include a portion intersecting the rim, said portion being forwardly inclined in the direction of intended impeller rotation.

15. The impeller of claim 11 further comprising at least one cement filled notch extending cooperatively into both said ceramic cap member and said graphite body.

16. A molten metal impeller comprised of a graphite body having a central hub disposed upon a generally disk shaped base and at least two vanes extending from said hub and seated upon said base, a ceramic cap member engaging a top surface of said graphite body, at least one cement filled notch extending cooperatively into each of said cap member and said graphite body, the cap member having a central ring sized to overlay said hub and wings extending therefrom, said wings shaped to cooperatively overlay said vanes, each wing having a terminal end with a vane engaging edge and an opposed edge wherein each opposed edge is chamfered.

17. The impeller of claim 16 wherein said chamfer comprises an angle relative to a top surface of said ceramic cap member of between about 20 and 60°.

18. The impeller of claim 16 wherein said ceramic cap member is comprised of silicon carbide.

19. The impeller of claim 17 wherein said angle is between about 30 and 50°.

20. The impeller of claim 16 wherein an interface between said cap member and said graphite body consists of cement.

21. A molten metal impeller comprised of a graphite body, said body having an at least substantially cylindrical sidewall and opposed top and bottom end walls, at least one of said end walls forms an inlet comprised of multiple passages extending to said sidewall, said passages being defined by a plurality of radially extending vanes and a peripheral rim, said vanes having a terminal portion intersecting said rim, said terminal portion being canted in the intended direction of impeller rotation, and wherein sections of said rim between said vanes include a surface downwardly sloped away from the direction of intended impeller rotation.

22. The impeller of claim 21 wherein said sections are inwardly inclined from a peripheral edge to an edge forming said passages.

* * * * *